US009122211B2

(12) United States Patent
Tanaka

(10) Patent No.: US 9,122,211 B2
(45) Date of Patent: Sep. 1, 2015

(54) IMAGE FORMING APPARATUS WITH FUNCTION TO MEASURE GLOSS LEVEL

(71) Applicant: KYOCERA Document Solutions Inc., Osaka-shi, Osaka (JP)

(72) Inventor: Kazunori Tanaka, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/336,400

(22) Filed: Jul. 21, 2014

(65) Prior Publication Data

US 2015/0030344 A1 Jan. 29, 2015

(30) Foreign Application Priority Data

Jul. 29, 2013 (JP) ..... 2013-156963

(51) Int. Cl.
*G03G 15/20* (2006.01)
*G03G 15/00* (2006.01)

(52) U.S. Cl.
CPC ..... *G03G 15/2039* (2013.01); *G03G 15/5062* (2013.01); *G03G 2215/00805* (2013.01)

(58) Field of Classification Search
CPC ..... G03G 15/2039; G03G 2215/00805; G03G 2215/0081
USPC ..... 399/67, 341
See application file for complete search history.

(56) References Cited

FOREIGN PATENT DOCUMENTS

| | | | |
|---|---|---|---|
| JP | 07271135 A | * | 10/1995 |
| JP | 07-311506 | | 11/1995 |
| JP | 2007-334189 | | 12/2007 |
| JP | 2012063634 A | * | 3/2012 |

OTHER PUBLICATIONS

Fujimaki (JP 07-271135 A), Oct. 1995, JPO Computer Translation.*
Yamauchi (JP 2007-334189 A), Dec. 2007, JPO Computer Translation.*

* cited by examiner

*Primary Examiner* — Erika J Villaluna
(74) *Attorney, Agent, or Firm* — Gerald E. Hespos; Michael J. Porco; Matthew T. Hespos

(57) ABSTRACT

An image forming apparatus includes a fixing unit, a gloss level measuring section, and a fixation condition setting section. The gloss level measuring section measures a gloss level of an image portion and a gloss level of a non-image portion in a recording medium after fixation, and separately measures, as the gloss level of the image portion, a first gloss level indicative of a gloss level of a chromatic toner image and a second gloss level indicative of a gloss level of a black toner image. The fixation condition setting section sets the fixation condition for the fixing unit so that the first gloss level and the second gloss level approach respective different target gloss levels, on the basis of a measured value of the first gloss level and a measured value of the second gloss level and a measured value of the gloss level of the non-image portion.

3 Claims, 4 Drawing Sheets

IMAGE FORMING APPARATUS WITH FUNCTION TO MEASURE GLOSS LEVEL

The present application is based on Japanese Patent Application No. 2013-156963 filed with the Japan Patent Office on Jul. 29, 2013 and the contents of the application are incorporated herein by reference.

BACKGROUND

The disclosure relates to an image forming apparatus.

In electrophotographic printing, the gloss level of an image is a factor determining image quality. In general, image quality is considered to be high when the gloss level of a toner surface (image portion) on a recording medium is not significantly different from the gloss level of the recording medium itself (non-image portion).

This is because the gloss level of the image portion excessively lower than the gloss level of the non-image portion leads to a visually dull impression. In contrast, the gloss level of the image portion excessively higher than the gloss level of the non-image portion leads to an increased amount of reflected light. In this case, the image is difficult to view, and particularly for a document image, characters are difficult to read. Furthermore, the gloss level depends significantly on the type of the recording medium used. For example, the gloss level increases and decreases consistently with the smoothness of the surface of the recording medium.

To deal with such a problem, a technique has been provided in which the thickness and gloss level of the recording medium are detected so that a fixation condition is changed in accordance with the thickness and gloss level, thus allowing the gloss level to be controlled for a variety of recording media. With this technique, however, the fixation condition does not reflect the actual image gloss level after fixation.

In contrast, another technique allows sensing of the gloss level of a toner image portion fixed on the recording medium and of a non-image portion with no toner image. This technique involves setting an appropriate gloss level reference value for the image portion in association with the gloss level of the non-image portion and controlling the fixation condition so that the gloss level of the image portion falls within the range of the reference value. Even when images are formed on a recording medium with a different surface gloss or smoothness level, this control allows images with a gloss level appropriate to the recording medium to be output.

SUMMARY

An image forming apparatus according to an aspect of the disclosure includes a fixing unit, a gloss level measuring section, and a fixation condition setting section that sets a fixation condition for the fixing unit.

The gloss level measuring section measures a gloss level of an image portion and a gloss level of a non-image portion in a recording medium that has been subjected to fixation by the fixing unit. The gloss level measuring section separately measures, as the gloss level of the image portion, a first gloss level indicative of a gloss level of a chromatic toner image and a second gloss level indicative of a gloss level of a black toner image. The fixation condition setting section sets the fixation condition for the fixing unit so that the first gloss level and the second gloss level approach respective different target gloss levels, on the basis of a measured value of the first gloss level and a measured value of the second gloss level and a measured value of the gloss level of the non-image portion.

DETAILED DESCRIPTION

Figure 1:
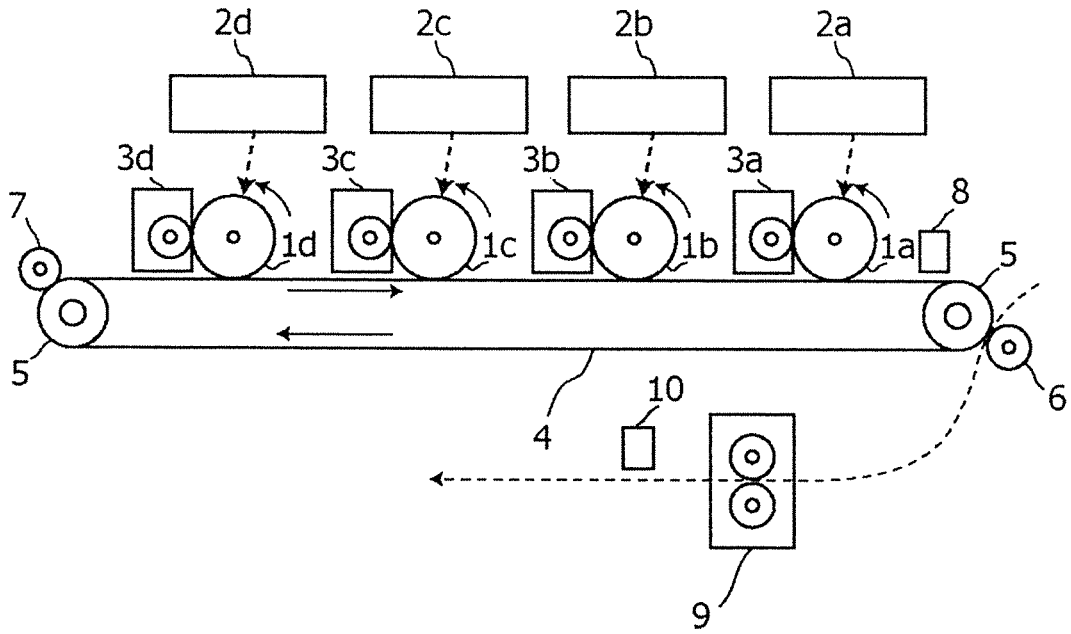
FIG. 1 is a side view showing a part of a mechanical internal configuration of an image forming apparatus according to an embodiment of the disclosure.

An embodiment of the disclosure will be described on the basis of the drawings. FIG. 1 is a side view showing a part of a mechanical internal configuration of an image forming apparatus according to the embodiment of the disclosure. The image forming apparatus is an image forming apparatus having an electrophotographic printing function, such as a printer, a facsimile apparatus, a copier, or a multifunction printer.

The image forming apparatus according to the embodiment has a tandem color image forming unit. The color image forming unit has photosensitive drums 1*a* to 1*d*, exposure apparatuses 2*a* to 2*d*, and development apparatuses 3*a* to 3*d*. The photosensitive drums 1*a* to 1*d* are photoreceptors for four colors, cyan, magenta, yellow, and black. The exposure apparatuses 2*a* to 2*d* are apparatuses that irradiate the photosensitive drums 1*a* to 1*d*, respectively, with laser light to form electrostatic latent images. The exposure apparatuses 2*a* to 2*d* are each a laser scanning unit having a laser diode serving as a light source of laser light and an optical element (a lens, a mirror, a polygon mirror, or the like) that guides the laser light to a corresponding one of the photosensitive drums 1*a* to 1*d*.

Moreover, a charger such as a scorotron, a cleaning apparatus, a static eliminator, and the like are arranged around each the photosensitive drums 1*a* to 1*d*. The cleaning apparatus removes toner remaining on the corresponding one of the photosensitive drums 1*a* to 1*d* after primary transfer. The static eliminator eliminates static electricity from the corresponding one of the photosensitive drums 1*a* to 1*d* after primary transfer.

The development apparatuses 3*a* to 3*d* include toner containers installed therein and in which toners in four colors, cyan, magenta, yellow, and black, respectively, are filled. The toner is fed from the toner containers. The toner provides a developer along with a carrier. Each of the development apparatuses 3*a* to 3*d* attaches the toner to an electrostatic image on the corresponding one of the photosensitive drums 1*a* to 1*d* to form a toner image.

The photosensitive drum 1*a*, the exposure apparatus 2*a*, and the development apparatus 3*a* develop magenta images. The photosensitive drum 1*b*, the exposure apparatus 2*b*, and the development apparatus 3*b* develop cyan images. The photosensitive drum 1*c*, the exposure apparatus 2*c*, and the development apparatus 3*c* develop yellow images. The photosensitive drum 1*d*, the exposure apparatus 2*d*, and the development apparatus 3*d* develop black images.

An intermediate transfer belt 4 is an annular image bearer that is in contact with the photosensitive drums 1*a* to 1*d* so that toner images on the photosensitive drums 1*a* to 1*d* are primarily transferred. The intermediate transfer belt 4 is passed around driving rollers 5 and rotates circumferentially from a position of contact with the photosensitive drum 1*d* toward a position of contact with the photosensitive drum 1*a*, under the driving force exerted by the driving rollers 5.

A transfer roller 6 brings a conveyed recording medium (print sheet) into contact with the intermediate transfer belt 4 to secondarily transfer the toner image on the intermediate transfer belt 4 to the recording medium. The recording medium with the toner image transferred thereto is conveyed to a fixing unit 9.

A roller 7 has a cleaning brush that is in contact with the intermediate transfer belt 4. The roller 7 removes the toner remaining on the intermediate transfer belt 4 after the toner image is transferred to the recording medium.

A sensor 8 is a sensor used to adjust a toner concentration and irradiates the intermediate transfer belt 4 with a light beam to detect the resultant reflected light.

The fixing unit 9 presses and heats the recording medium with the toner image transferred thereto using a pressure roller and a fixing roller, to fix the toner image to the recording medium. The recording medium with the toner image fixed thereto by the fixing unit 9 is discharged into a discharge tray or the like through a predetermined conveyance path and a discharge port.

A gloss level sensor 10 is arranged on the conveyance path between the discharge port and the fixing unit 9 or at the discharge port to detect the gloss level.

Figure 2:
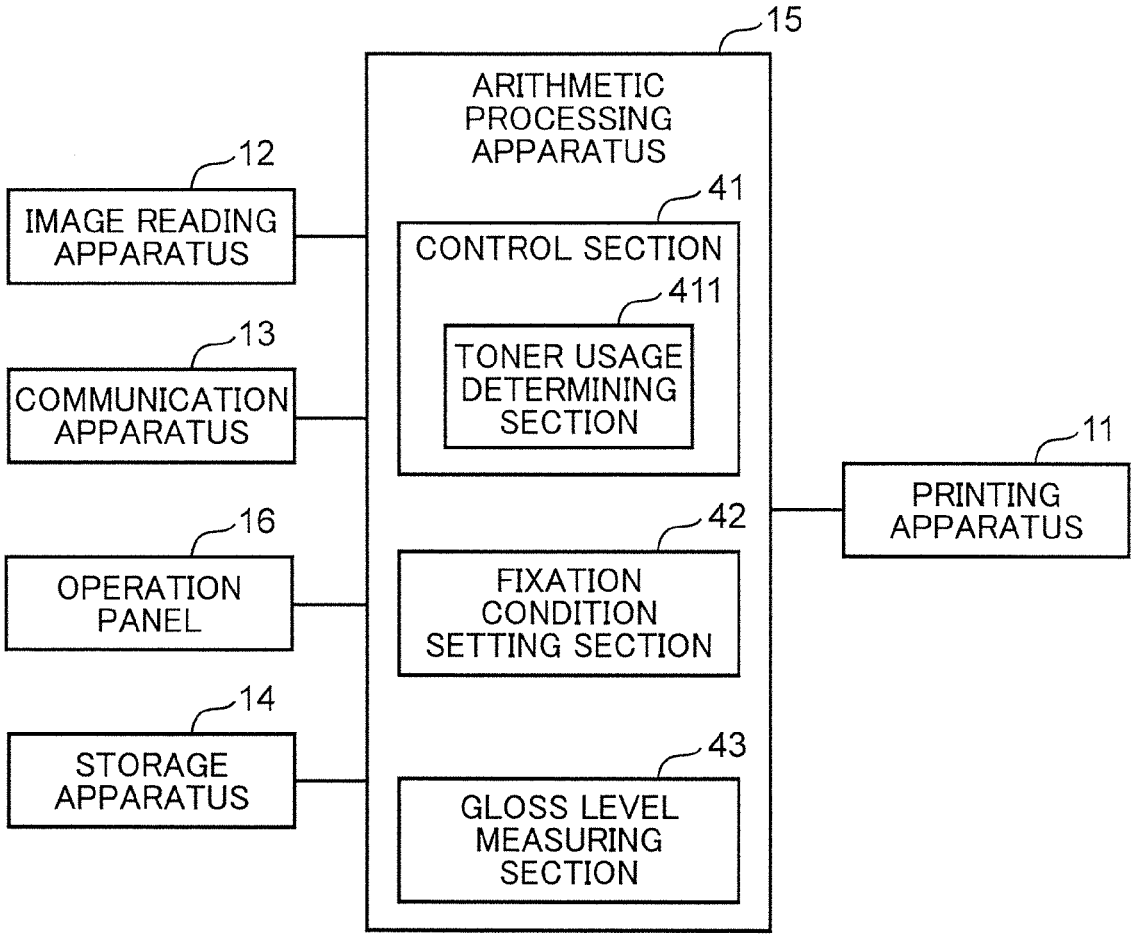
FIG. 2 is a block diagram showing the configuration of the image forming apparatus.

FIG. 2 is a block diagram showing the configuration of the image forming apparatus according to the embodiment of the disclosure. As shown in FIG. 2, the image forming apparatus includes a printing apparatus 11, an image reading apparatus 12, a communication apparatus 13, a storage apparatus 14, an arithmetic processing apparatus 15, and an operation panel 16.

The printing apparatus 11 is an internal apparatus controlled by the arithmetic processing apparatus 15 and configured as shown in FIG. 1 to print color images based on image data. The image reading apparatus 12 is an internal apparatus optically reading a document image from a document to generate color image data on the document image.

The communication apparatus 13 is an apparatus that performs data communication with a host apparatus (not shown in the drawings) via a computer network and the like. For example, the communication apparatus 13 receives print request data such as page description language (PDL) data from the host apparatus (not shown in the drawings) and generates image data from the print request data. The storage apparatus 14 is a nonvolatile storage apparatus such as a flash memory.

The arithmetic processing apparatus 15 has an application specific integrated circuit (ASIC) and/or a microcomputer to implement various processing sections using hardware and/or software. The arithmetic processing apparatus 15 functionally implements a control section 41, a fixation condition setting section 42, and a gloss level measuring section 43.

The control section 41 controls the image reading apparatus 12 to acquire image data on a document image (original image data on an image to be printed) or generates original image data on an image to be printed from the print request data received from the communication apparatus 13. Moreover, the control section 41 allows the printing apparatus 11 to print an image based on image data resulting from resolution conversion, color conversion, screen processing, and the like performed inside the arithmetic processing apparatus 15. For printing of an image, the control section 41 allows the fixing unit 9 to perform fixation under a fixation condition (a temperature at which the fixing roller performs fixation, a speed at which the recording medium is conveyed, a pressure load imposed by the pressure roller, or the like). The fixation condition setting section 42 determines and sets the fixation condition in the control section 41.

When the fixation condition is adjusted, the gloss level measuring section 43 uses the control section 41 to allow the printing apparatus 11 to print the patch images for the respective colors on the recording medium. The gloss level measuring section 43 subsequently uses the gloss level sensor 10 to measure the gloss level of the patch image (hereinafter referred to as an image portion) for each toner color and the gloss level of an area with no patch image present therein (that is, the recording medium itself; hereinafter referred to as a non-image portion).

Figure 3:
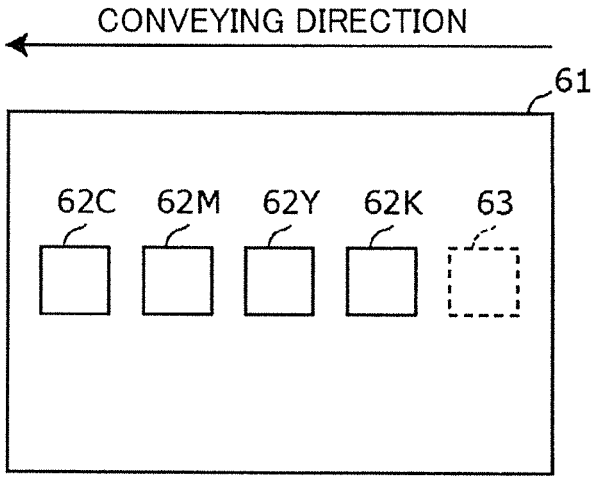
FIG. 3 is a diagram showing an example of patch images for respective toner colors used to adjust a fixation condition.

FIG. 3 is a diagram showing an example of the patch images for the respective toner colors used to adjust the fixation condition. As the gloss level of the image portion of the recording medium 61, the gloss level measuring section 43 separately measures the gloss level (first gloss level) of the chromatic toner image (in other words, a monochromatic patch image for cyan toner 62C, a monochromatic patch image for magenta toner 62M, or a monochromatic patch image for yellow toner 62Y) and the gloss level (second gloss level) of the black toner image (in other words, a monochromatic patch image for black toner 62K). Moreover, the gloss level measuring section 43 measures the gloss level of a non-image portion 63.

The fixation condition setting section 42 sets the fixation condition for the fixing unit 9. Specifically, based on the measured value of the gloss level of the chromatic toner image (monochromatic patch image 62C, 62M, or 63Y) and the measured value of the gloss level of the black toner image (monochromatic path image 62K) and the measured value of the gloss level of the non-image portion 63, the fixation condition setting section 42 sets the fixation condition for the fixing unit 9 so that the gloss level of the chromatic toner image and the gloss level of the black toner image approach respective target gloss levels.

The control section 41 includes a toner usage determining section 411. When an image based on input image data from the image reading apparatus 12 or the communication apparatus 13 is printed, the control section 41 (toner usage determining section 411) determines the amount of chromatic toner used in the image based on the input image data and the amount of black toner used in the image. Based on the amounts of chromatic toner and black toner used which have been determined by the control section 41, the fixation condition setting section 42 sets, in the control section 41, the fixation condition for the fixing unit 9 during printing of the image.

In the embodiment, the gloss level of the chromatic toner image (first gloss level) is any one of the gloss level of the cyan toner image, the gloss level of the magenta toner image and the gloss level of the yellow toner image, or the average value of a plurality of the gloss levels from among the gloss level of the cyan toner image, the gloss level of the magenta toner image, and the gloss level of the yellow toner image. The control section 41 determines, as the number of toner used, the first number of pixels, which is the number of pixels in the input image data for which the value of the amount of toner used is not zero for at least one of cyan, magenta and yellow, and the second number of pixels, which is the number of pixels in the input image data for which the value of the amount of toner used is zero for cyan, magenta and yellow, whereas the value of the amount of toner used is not zero for black.

The fixation condition setting section 42 executes processes (a) and (b) described below.

(a) Based on the measured value of the gloss level of the non-image portion 63, a first target gloss level for the gloss level of the chromatic toner image and a second target gloss level for the gloss level of the black toner image are set. A plurality of fixation conditions is recorded under which the difference between the measured value of the gloss level of the chromatic toner image and the first target gloss level is smaller than a predetermined threshold and under which the difference between the measured value of the gloss level of the black toner image and the second target gloss level is smaller than a predetermined threshold.

(b) As a fixation condition for the fixing unit 9 during printing of an image based on input image data, one of the plurality of recorded fixation conditions that involves the smallest difference between the measured value of the gloss level of the chromatic toner image and the first target gloss level is selected when the first number of pixels is larger than the second number of pixels. On the other hand, one of the plurality of recorded fixation conditions that involves the smallest difference between the measured value of the gloss level of the black toner image and the second target gloss level is selected when the second number of pixels is larger than the first number of pixels.

When the first number of pixels is the same as the second number of pixels, a fixation condition involving the smallest difference between the measured value of the gloss level of the black toner image and the second target gloss level may be selected. Furthermore, a fixation condition may be selected which involves the smallest difference between the difference between the measured value of the gloss level of the chromatic toner image and the first target gloss level and the difference between the measured value of the gloss level of the black toner image and the second target gloss level.

The operation panel 16 has a display apparatus that shows various messages and information to a user and an input apparatus that accepts a user operation.

Now, operation of the image forming apparatus will be descried.

(1) Adjustment of the Fixation Condition for the Fixing Unit 9

Figure 4:
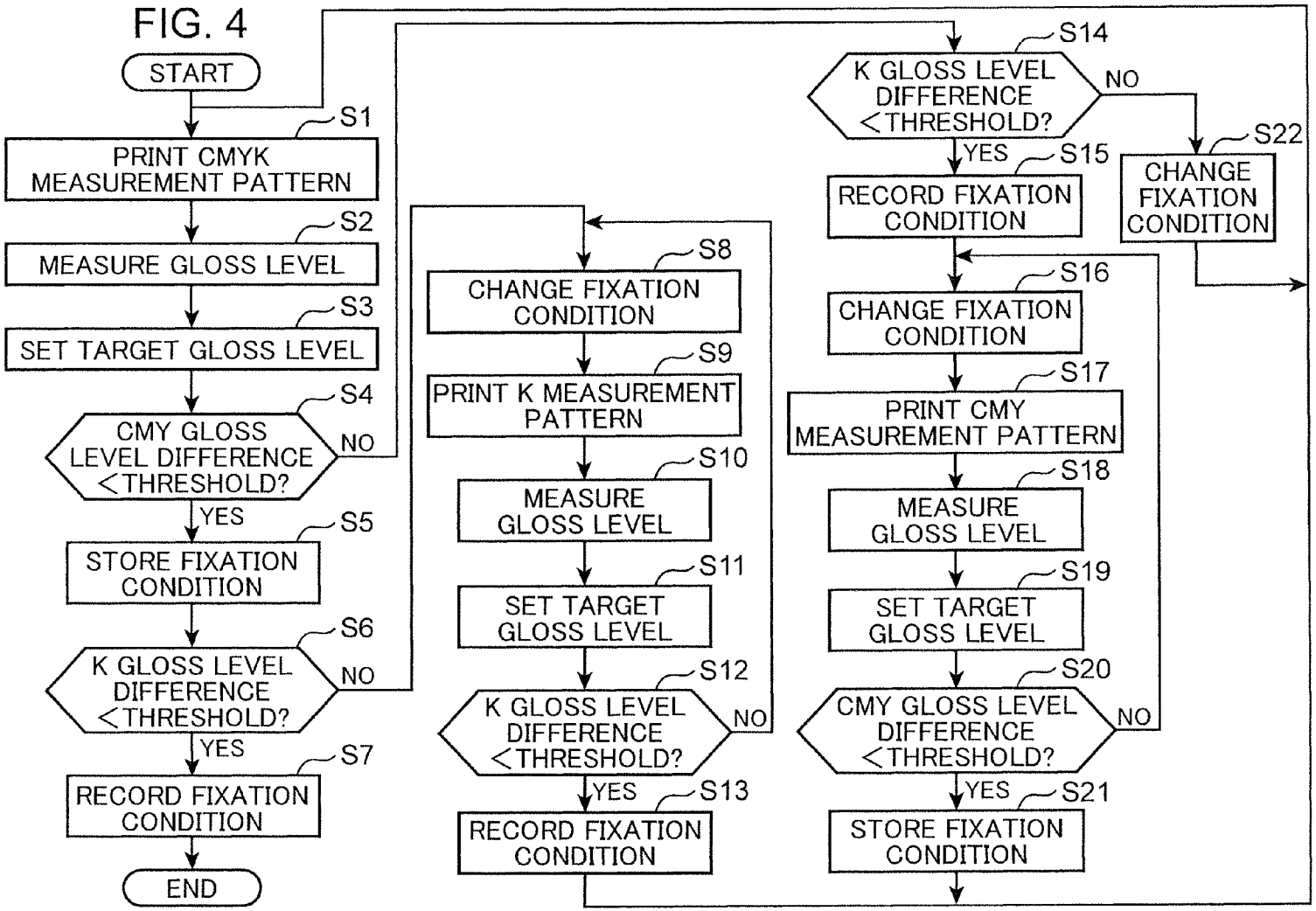
FIG. 4 is a flowchart showing a process for adjusting the fixation condition for a fixing unit, which process is executed by the image forming apparatus.

FIG. 4 is a flowchart showing a process for adjusting the fixation condition for the fixing unit 9, which process is executed by the image forming apparatus shown in FIG. 1 and FIG. 2. The user depresses a gloss level adjustment button (not shown in the drawings) displayed on the operation panel 16 to allow adjustment of the fixation condition for the fixing unit 9 described below to be performed for gloss level adjustment.

First, the gloss level measuring section 43 allows the CMYK monochromatic patch images 62C, 62M, 62Y, and 62K shown in FIG. 2 to be printed on the recording medium (step S1). The gloss level measuring section 43 then uses the gloss level sensor 10 to measure the gloss levels of the monochromatic patch images 62C, 62M, 62Y, and 62K and the gloss level of the non-image portion 63 (step S2). An initial value for the fixation condition is appropriately set each time the appropriate fixation condition is searched for.

Then, based on the measured value of the gloss level of the non-image portion 63, the fixation condition setting section 42 sets a first target gloss level and a second target gloss level which correspond to the measured value of the gloss level of the non-image portion 63 and which are different from each other (step S3). The second target gloss level is higher than the first target gloss level. For example, the first target gloss level is a value that is approximately the same as the gloss level of the non-image portion 63.

The fixation condition setting section 42 then determines whether or not the (absolute value of) difference between the measured value of the gloss level of the monochromatic patch image 62C, 62M, or 62Y and the first target gloss level is smaller than a predetermined threshold (step S4).

When the difference between the measured value of the gloss level of the monochromatic patch image 62C, 62M, or 62Y and the first target gloss level is smaller than the predetermined threshold, the fixation condition setting section 42 records this difference and the current fixation condition (step S5). Moreover, the fixation condition setting section 42 determines whether or not the (absolute value of) difference between the measured value of the gloss level of the monochromatic patch image 62K and the second target gloss level is smaller than a predetermined threshold (step S6).

When the difference between the measured value of the gloss level of the monochromatic patch image 62K and the second target gloss level is smaller than the predetermined threshold, the fixation condition setting section 42 records the difference in association with the difference and the current fixation condition recorded in step S5. The fixation condition setting section 42 records the fixation condition as an appropriate fixation condition for CMYK (step S7).

On the other hand, in step S6, when the difference between the measured value of the gloss level of the monochromatic patch image 62K and the second target gloss level is equal to or larger than the predetermined threshold, the fixation condition setting section 42 changes the fixation condition so that the gloss level of the black toner approaches the second target gloss level (step S8). The gloss level measuring section 43 allows the monochromatic patch image 62K to be printed on the recording medium (step S9) and measures the gloss level of the monochromatic patch image 62K and the gloss level of the non-image portion 63 (step S10).

The fixation condition setting section 42 resets the second target gloss level on the basis of the currently measured gloss level of the non-image portion 63 (step S11). The fixation condition setting section 42 determines whether or not the difference between the measured value of the gloss level of the monochromatic patch image 62K and the second target gloss level is smaller than the predetermined threshold (step S12).

As described above, the processing in steps S8 to S12 is repeatedly executed until the difference between the measured value of the gloss level of the monochromatic patch image 62K and the second target gloss level becomes smaller than the predetermined threshold.

When the processing in steps S8 to S12 has made the difference between the measured value of the gloss level of the monochromatic patch image 62K of the black toner and the second target gloss level smaller than the predetermined threshold, the fixation condition setting section 42 records the current fixation condition (step S13). Then, the fixation condition setting section 42 returns to step S1 to check again whether both the chromatic toner image and the black toner image are at the appropriate gloss level.

On the other hand, in step S4, when the difference between the measured value of the gloss level of the monochromatic patch image 62C, 62M, or 62Y and the first target gloss level is equal to or larger than the predetermined threshold, the fixation condition setting section 42 determines whether or not the (absolute value of) difference between the measured value of the gloss level of the monochromatic patch image 62K and the second target gloss level is smaller than the predetermined threshold (step S14).

When the difference between the measured value of the gloss level of the monochromatic patch image 62K and the second target gloss level is smaller than the predetermined threshold, the fixation condition setting section 42 records this difference and the current fixation condition (step S15).

The fixation condition setting section 42 changes the fixation condition so that the gloss level of the chromatic toner approaches the first target gloss level (step S16). The gloss level measuring section 43 allows the monochromatic patch images 62C, 62M, and 62Y to be printed on the recording medium (step S17). The gloss level measuring section 43 then measures the gloss of the monochromatic patch image 62C, 62M, or 62Y and the gloss level of the non-image portion 63 (step S18).

The fixation condition setting section 42 resets the first target gloss level on the basis of the currently measured gloss level of the non-image portion 63 (step S19). The fixation condition setting section 42 determines whether or not the difference between the measured value of the gloss level of the monochromatic patch image 62C, 62M, or 62Y and the first target gloss level is smaller than the predetermined threshold (step S20).

As described above, the processing in steps S16 to S20 is repeatedly executed until the difference between the measured value of the gloss level of the monochromatic patch image 62C, 62M, or 62Y and the first target gloss level becomes smaller than the predetermined threshold.

When the processing in steps S16 to S20 has made the difference between the measured value of the gloss level of the monochromatic patch image 62C, 62M, or 62Y and the first target gloss level smaller than the predetermined threshold, the fixation condition setting section 42 records the current fixation condition (step S21). Then, the fixation condition setting section 42 returns to step S1 to check again whether both the chromatic toner image and the black toner image are at the appropriate gloss level.

Furthermore, in step S14, when the difference between the measured value of the gloss level of the monochromatic patch image 62K and the second target gloss level is equal to or larger than the predetermined threshold, the fixation condition setting section 42 changes the fixation condition so that the gloss level of the chromatic toner approaches first target gloss level, whereas the gloss level of the black toner approaches the second target gloss level (step S22). The fixation condition setting section 42 subsequently returns to step S1 to check again whether both the chromatic toner image and the black toner image are at the appropriate gloss level.

As described above, the fixation condition under which both the chromatic toner and the black toner exhibit the appropriate gloss level is recorded in the storage apparatus 14. A plurality of executions of this process allows a plurality of fixation conditions under which both the chromatic toner and the black toner exhibit the appropriate gloss level to be recorded in the storage apparatus 14.

(2) Setting the Fixation Condition for Image Printing Based on Input Image Data

Figure 5:
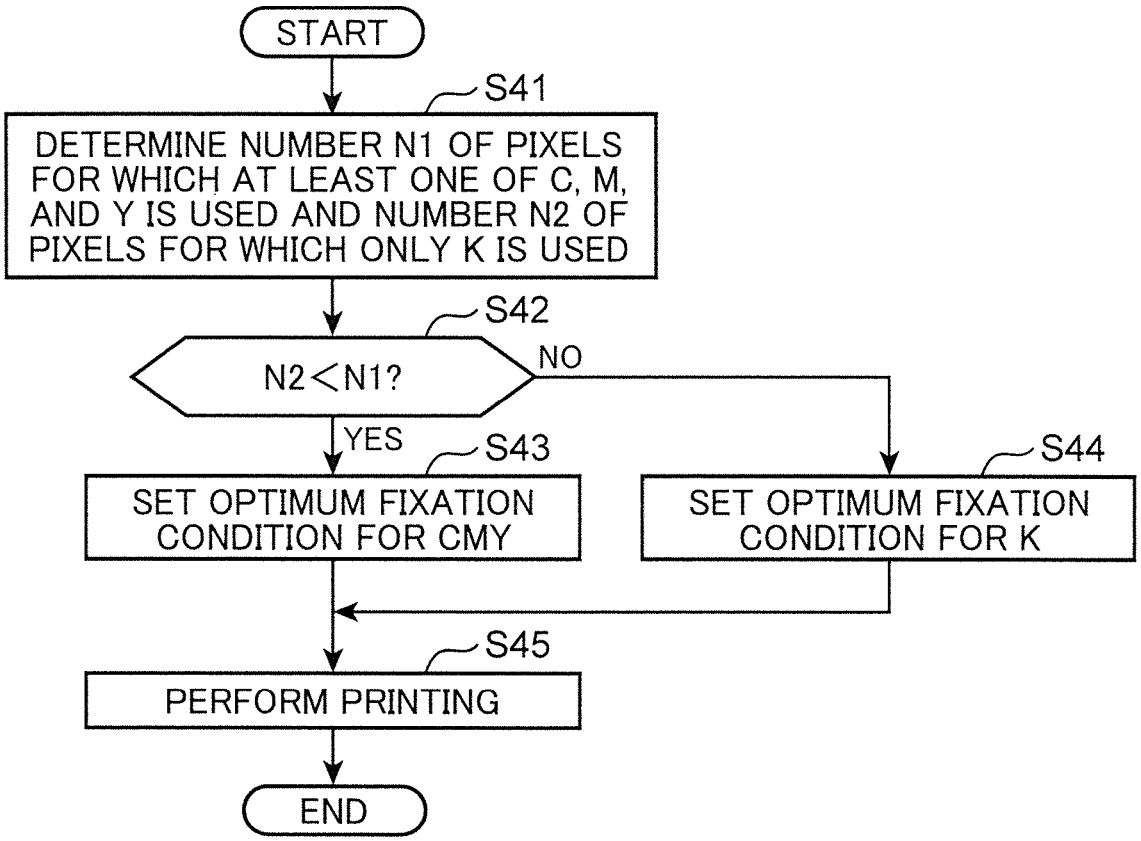
FIG. 5 is a flowchart showing a process for setting the fixation condition during printing of an image based on input image data, which process is executed by the image forming apparatus.

FIG. 5 is a flowchart showing a process for setting the fixation condition during printing of an image based on input image data which process is executed by the image forming apparatus shown in FIG. 1 and FIG. 2.

When printing an image based on input image data in association with the user's print request from the host apparatus (not shown in the drawings), the user's copy request made via the operation panel 16, or the like, the control section 41 determines the number N1 of pixels in CMYK image data resulting from a color conversion of the input image data for which the value of the amount of toner used is not zero for at least one of the C, M and Y, and the number N2 of pixels in the CMYK data for which the value of the amount of toner used is zero for all of the C, M and Y, whereas the value of the amount of toner used is not zero for the K (step S41). Normally, the N1 is large when the image based on the input image data is a color photograph image, and the N2 is large when the image based on the input image data is a document image.

The control section 41 determines whether the N1 is larger than the N2 (step S42). When the N1 is larger than the N2, the control section 41 selects one of the plurality of recorded fixation conditions which involves the smallest difference between the CMY gloss level and the corresponding target gloss level and sets this fixation condition in the control section 41 (step S43). On the other hand, when the N1 is equal to or smaller than the N2, the control section 41 selects one of the plurality of recorded fixation conditions which involves the smallest difference from the K gloss level and the corresponding target gloss level for K and sets this fixation condition in the control section 41 (step S44).

Then, the control section 41 allows the printing apparatus 11 to print the image under the set fixation condition (step S45).

As described above, according to the embodiment, the gloss level measuring section 43 separately measures the gloss level of the chromatic toner image and the gloss level of the black toner image as the gloss level of the image portion printed on the recording medium during adjustment of the fixation condition. Based on the measured value of the gloss level of the chromatic toner image and the measured value of the gloss level of the black toner image and the gloss level of the non-image portion on the recording medium, the fixation condition setting section 42 sets the fixation condition for the fixing unit 9 so that the gloss level of the chromatic toner image and the gloss level of the black toner image approach respective different target gloss levels.

Thus, the image printing apparatus can print an image with the appropriate gloss level on the recording medium regardless of the type of the recording medium.

The embodiment is preferred examples of the disclosure, but the disclosure is not limited to the embodiment. Many variations and changes may be made to the embodiment without departing from the spirits of the disclosure.

For example, a target gloss level may be set for each of the C, M, and Y colors so that a fixation condition can be recorded under which the differences between all the monochromatic patch images 62C, 62M, and 62Y for CMY and the corresponding target gloss levels are all smaller than a threshold. Moreover, in this case, one of the recorded fixation conditions may be selected and used which involves the smallest difference for one of the C, M, and Y colors for which the largest amount of toner is used in the image based on the input image data.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus comprising:

a fixing unit;

a gloss level measuring section that measures a gloss level of an image portion and a gloss level of a non-image portion in a recording medium that has been subjected to fixation by the fixing unit;

a fixation condition setting section that sets a fixation condition for the fixing unit; and a toner usage determining section that determines an amount of chromatic toner used in an image based on input image data and an amount of black toner used in the image;

wherein:

the gloss level measuring section separately measures, as the gloss level of the image portion, a first gloss level indicative of a gloss level of a chromatic toner image and a second gloss level indicative of a gloss level of a black toner image, and the fixation condition setting section:

sets the fixation condition for the fixing unit so that the first gloss level and the second gloss level approach respective different target gloss levels, on the basis of a measured value of the first gloss level and a measured value of the second gloss level and a measured value of the gloss level of the non-image portion, and sets the fixation condition for the fixing unit during printing of the image, on the basis of the amount of chromatic toner used and the amount of black toner used that have been determined by the toner usage determining section, the first gloss level is any one of a gloss level of a cyan toner image, a gloss level of a magenta toner image and a gloss level of a yellow toner image, or an average value of a plurality of the gloss levels from among the gloss level of the cyan toner image, the gloss level of the magenta toner image and the gloss level of the yellow toner image, the toner usage determining section determines a first number of pixels, which is the number of pixels in the input image data for which a value of the amount of toner used is not zero for at least one of cyan, magenta and yellow, and a second number of pixels which is the number of pixels in the input image data for which the value of the amount of toner used is zero for cyan, magenta and yellow, whereas the value of the amount of toner used is not zero for black, and the fixation condition setting section (a) sets a first target gloss level for the first gloss level and a second target gloss level for the second gloss level on the basis of the measured value of the gloss level of the non-image portion, and records a plurality of fixation conditions under which a difference between the measured value of the first gloss level and the first target gloss level is smaller than a predetermined threshold and under which a difference between the measured value of the second gloss level and the second target gloss level is smaller than a predetermined threshold, and (b) as the fixation condition for the fixing unit during printing of the image, selects one of the plurality of recorded fixation conditions that involves a smallest difference between the measured value of the first gloss level and the first target gloss level when the first number of pixels is larger than the second number of pixels, and selects one of the plurality of recorded fixation conditions that involves a smallest difference between the measured value of the second gloss level and the second target gloss level when the second number of pixels is larger than the first number of pixels.

2. An image forming apparatus, comprising:

a fixing unit;

a gloss level measuring section that measures a gloss level of an image portion and a gloss level of a non-image portion in a recording medium that has been subjected to fixation by the fixing unit; and a fixation condition setting section that sets a fixation condition for the fixing unit;

wherein:

the gloss level measuring section separately measures, as the gloss level of the image portion, a first gloss level indicative of a gloss level of a chromatic toner image and a second gloss level indicative of a gloss level of a black toner image, the fixation condition setting section sets the fixation condition for the fixing unit so that the first gloss level and the second gloss level approach respective different target gloss levels, on the basis of a measured value of the first gloss level and a measured value of the second gloss level and a measured value of the gloss level of the non-image portion, and the fixation condition setting section sets a first target gloss level and a second target gloss level which correspond to the measured value of the gloss level of the non-image portion and which are different from each other, and sets, as the fixation condition for the fixing unit, a condition under which a difference between the first gloss level and the first target gloss level is smaller than a predetermined threshold and under which a difference between the second gloss level and the second target gloss level is smaller than the predetermined threshold.

3. The image forming apparatus according to claim 1, further comprising:

a discharge port for a recording medium that has been subjected to fixation by the fixing unit; and a gloss level sensor arranged at the discharge port or on a conveyance path between the discharge port and the fixing unit; wherein the gloss level measuring section uses the gloss level sensor to measure the gloss level of the image portion and the gloss level of the non-image portion.

* * * * *